US005414325A

United States Patent [19]

Allison

[11] Patent Number: 5,414,325

[45] Date of Patent: May 9, 1995

[54] GAS DISCHARGE LAMP BALLAST CIRCUIT WITH AUTOMATICALLY CALIBRATED LIGHT FEEDBACK CONTROL

[75] Inventor: Joseph M. Allison, Euclid, Ohio

[73] Assignee: General Electric Company, Schenectady, N.Y.

[21] Appl. No.: 227,750

[22] Filed: Apr. 13, 1994

[51] Int. Cl.[6] ..... H05B 37/02

[52] U.S. Cl. ..... 315/158; 315/156; 315/154; 315/149; 315/307

[58] Field of Search ..... 315/209 R, 158, 156, 315/154, 149, 307

[56] References Cited

U.S. PATENT DOCUMENTS

| | | | |
|---|---|---|---|
| 4,236,101 | 11/1980 | Luchaco | 315/158 |
| 4,668,895 | 5/1987 | Schneiter | 315/156 |
| 4,697,122 | 9/1987 | Hoffer | 315/158 |
| 5,340,974 | 8/1994 | Zalewski | 315/158 |

*Primary Examiner*—Robert J. Pascal
*Assistant Examiner*—Reginald A. Ratliff
*Attorney, Agent, or Firm*—George E. Hawranko; Stanley C. Corwin

[57] ABSTRACT

Disclosed is a ballast circuit for a high pressure gas discharge lamp, including a comparator circuit for producing a feedback error signal representing the difference between a feedback signal and a reference signal. The feedback signal is selectively one of a non-light feedback signal and a light feedback signal, as determined by a switching circuit. A power control circuit adjusts the level of power supplied to the lamp in response to the feedback error signal. A first, non-light feedback circuit supplies a non-light feedback signal to the comparator circuit, based on non-light information of the lamp that is fed back to the non-light feedback circuit. A light feedback circuit operative during a lamp warm-up period supplies a light feedback signal to the comparator circuit based on light intensity information that is fed back to the light feedback circuit. The light feedback circuit has an adjustable gain as determined by the difference between measured light intensity and magnitude of the light feedback signal produced. A calibration circuit, operative during steady state lamp operation when the comparator circuit is responsive to the non-light feedback signal, automatically adjusts the gain of the light feedback circuit until a state is reached in which switching to light feedback control would result in substantially no change in light intensity. The calibration circuit includes a calibration memory for storing the gain for use in a subsequent period of lamp warm-up.

10 Claims, 2 Drawing Sheets

22
FEEDBACK
20
F1
16
16A
E
10
12
14
VRI
10A
F2
24
16B
26
28
34
F2'
30
30A
I → V
D → A
CONVERTER
38
30B
32B
UP/DOWN
UP / DOWN
COUNTER
CLOCK
VRI
32A
32
18
LOGIC
CONTROL
(FIG. 2)

GAS DISCHARGE LAMP BALLAST CIRCUIT WITH AUTOMATICALLY CALIBRATED LIGHT FEEDBACK CONTROL

FIELD OF THE INVENTION

The present invention relates to an electronic ballast, or power supply, circuit for a high pressure gas discharge lamp, and more particularly, to such a ballast circuit that provides light feedback control during a lamp warm-up period.

BACKGROUND OF THE INVENTION

In certain types of lamp systems, it is desirable that the lamp produce a non-wavering, or uniform, level of light as soon as the lamp is turned on. This is particularly true in automotive headlamp systems. Certain types of high pressure gas discharge lamps, however, are apt to exhibit a non-uniform level of light intensity during a lamp warm-up period. A metal halide lamp, for instance, includes, within a sealed arc tube, a gaseous mixture including vaporized mercury during steady state lamp operation. When the lamp has just become powered and is warming up from ambient temperature, however, the mercury is still in a liquid state and tends to condense on the inner wall of the arc tube. The condensed mercury tends to block light from being transmitted to outside the arc tube.

In order to provide essentially instant light output from a metal halide lamp, xenon has been incorporated into the gaseous mixture within the arc tube. U.S. Pat. No. 5,239,230 issued to Mathews et al on Aug. 24, 1993 and assigned to the same assignee disclosed such a light source. Additionally, another such light source is disclosed in U.S. Pat. No. 5,059,865 issued to Bergman et al on Oct. 22, 1991 is also assigned to the same assignee as the present invention. However, mercury condensation, as mentioned above, still partially blocks the xenon-generated light from being transmitted to outside the arc tube. When the lamp has eventually warmed up, the mercury becomes vaporized, and undergoes quantum state emissions of electrons to produce light. Typical warm-up periods vary from about 40 seconds for a 60-watt lamp to about 7 minutes for a 400-watt lamp.

Amongst the various attempts in the prior art to assure a uniform level of light from a high pressure gas discharge lamp, one method takes advantage of the fact that lamp voltage increases during lamp warm-up. This voltage increase is due to mercury vaporization. The ballast circuit is designed to respond to lamp voltage, such that the ballast power delivered to the lamp is a decreasing function of lamp voltage. While improving the uniformity of light intensity during lamp warm-up, such method still falls considerably short of providing a highly uniform level of light that is constant to within, for instance, 5 percent.

Another prior method seeking to promote uniformity of light intensity during lamp warm-up uses a dual time-constant circuit, which "remembers" how long the lamp had been on during a prior run (within the immediately preceding 40 seconds) as well as how long it had been off (within the immediately preceding 6 minutes). The ballast applies a start-up power magnitude and decay time that depends on these two parameters. The longer the lamp had cooled, the longer the start-up power is applied and the longer it takes the applied power to decay to steady-state. The foregoing circuit is described in copending patent application Ser. No. 07/858,927, filed Mar. 27, 1992, for "Low Voltage Ballast Circuit for a High Brightness Discharge Light Source," by Joseph M. Allison (the instant inventor) and others. The foregoing application is assigned to the same assignee as the present invention, and its entire disclosure is hereby incorporated by reference. While promoting more uniformity in light intensity during lamp warm-up, however, the foregoing method still falls short of achieving a highly uniform level of light intensity within, for instance, 5 percent uniformity during lamp warm-up.

One possible approach to achieving high uniformity of light intensity during lamp warm-up would be to control the light intensity directly, i.e., by sampling a fraction of the light produced, and feeding back such light information to control circuitry for adjusting the level of power supplied to the lamp, to achieve a more uniform intensity of light. However, this approach, considered by itself, would likely encounter two, significant difficulties. One is that such approach is subject to a wide aberration in the level of light intensity produced, especially over time. That is, over time the percentage of total light intercepted by the feedback light sensor (i.e. the feedback fraction) may change due to accumulation of dirt on optical surfaces, or optical alignment disturbances, for instance. The sensitivity of a feedback control system having high loop gain to the feedback fraction is almost 100 percent. Thus, for example, a 20 percent decrease in the fraction of light sampled results in a 20 percent increase total light. Thus, the foregoing light feedback approach, considered by itself, would likely result in erratically different levels of light produced, especially over time.

A second difficulty with controlling light intensity directly as discussed above, is that an overall darkening of the lamp, from a layer of dirt, for instance, would reduce the amount of light fed back. The feedback circuit, in turn, would attempt to boost the power to the lamp, perhaps well beyond the capability of the lamp ballast, in an attempt to maintain the same level of light output. This would create an unusually large power usage, with potentially destructive consequences to the lamp and its ballast circuitry.

It would thus, be desirable, to provide a ballast circuit for a high pressure gas discharge lamp that utilizes light feedback control during a lamp warm-up period, but that avoids the foregoing problems of producing erratically different light levels as the sampled light intensity varies, and of creating an unusually large power usage for the lamp.

OBJECTS AND SUMMARY OF THE INVENTION

It, accordingly, is an object of the present invention to provide a ballast circuit for gas discharge lamp that uses light feedback control during a lamp warm-up period for promoting uniform light intensity during the warm-up period, while avoiding the problems of producing erratically different levels of light as a result of differences in light intensity measured from the lamp, and of creating an unusually large power usage for the lamp.

A further object of the invention is to provide a gas discharge lamp of the foregoing type whose feedback control and related circuitry can be incorporated into an integrated circuit already used for the ballast circuit.

In accordance with the invention, there is provided a ballast circuit for a high pressure gas discharge lamp, such as a metal halide lamp, a mercury lamp, or a sodium lamp. The ballast circuit includes a comparator circuit for producing a feedback error signal representing the difference between a feedback signal and a reference signal. The feedback signal is selectively one of a non-light feedback signal and a light feedback signal. A switching circuit makes the comparator circuit selectively responsive to one of the non-light feedback signal and the light feedback signal. A power control circuit adjusts the level of power supplied to the lamp in response to the feedback error signal. A first, non-light feedback circuit supplies a non-light feedback signal to the comparator circuit, based on non-light information of the lamp that is fed back to the non-light feedback circuit. A light feedback circuit operative during a lamp warm-up period supplies a light feedback signal to the comparator circuit based on light intensity information that is fed back to the light feedback circuit. The light feedback circuit has an adjustable gain as determined by the difference between measured light intensity and magnitude of the light feedback signal produced. A calibration circuit, operative during steady state lamp operation when the comparator circuit is responsive to the non-light feedback signal, automatically adjusts the gain of the light feedback circuit until a state is reached in which switching to light feedback control would result in substantially no change in light intensity. The calibration circuit includes a calibration memory for storing the gain for use in a subsequent period of lamp warm-up.

BRIEF DESCRIPTION OF THE DRAWING FIGURES

The foregoing, and further, objects and advantages of the invention will become apparent from the following description when read in conjunction with the drawing, in which.

DESCRIPTION OF THE PREFERRED EMBODIMENTS

Figure 1:
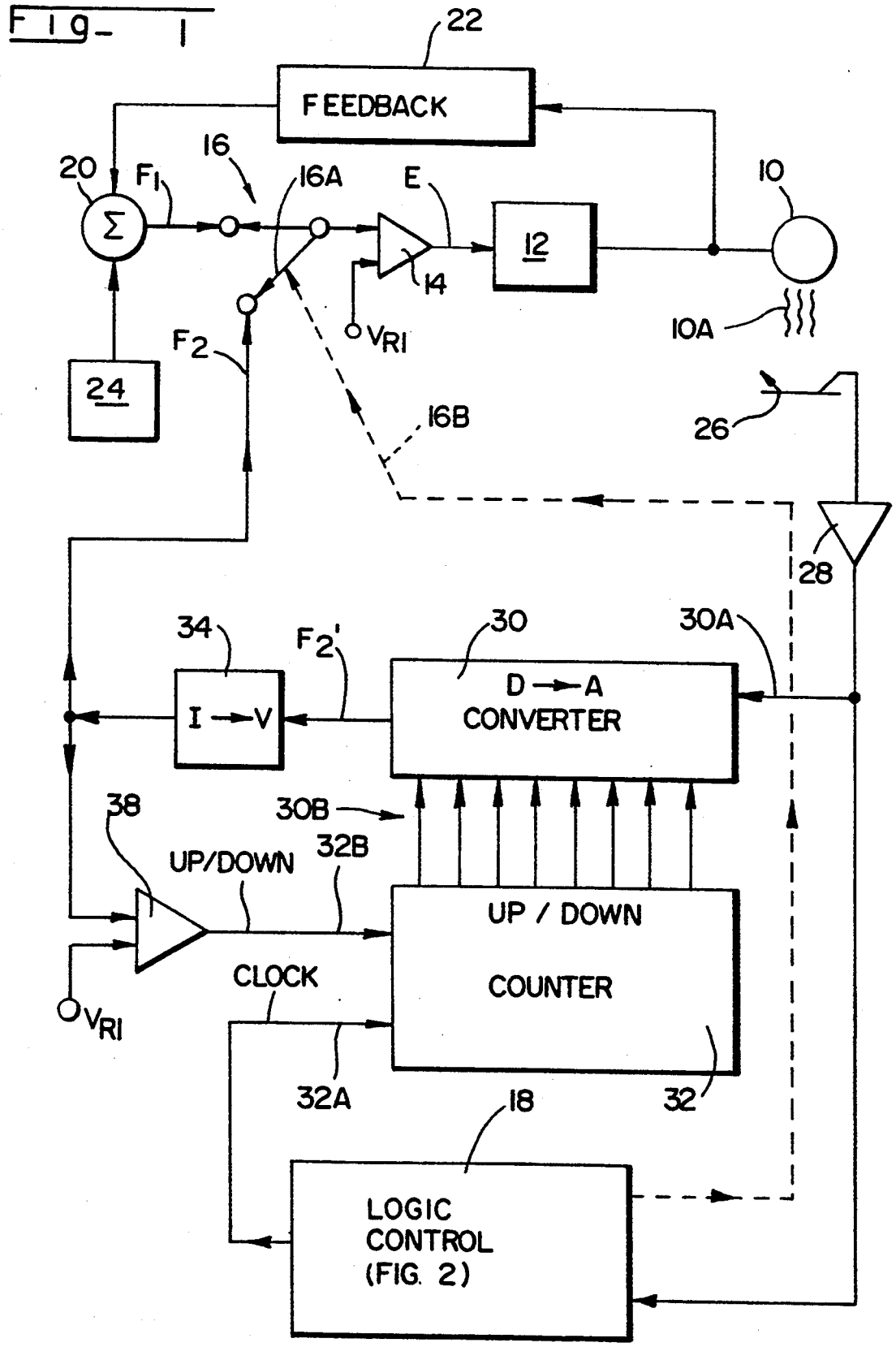
FIG. 1 is a schematic diagram, partially in block form, of an electronic ballast circuit for a high pressure discharge lamp employing, during a lamp warm-up period, light feedback control if the gain of the light feedback circuit has already been calibrated, or non-light feedback control if the gain of the light feedback control circuit is not calibrated.

FIG. 1 is a schematic circuit diagram, partially in block form, illustrating a ballast circuit for a gas discharge lamp employing circuitry for automatically calibrating a light feedback control. A high pressure gas discharge lamp 10, such as a metal halide lamp, or more preferably, a xenon-metal halide lamp, is controlled by a power supply circuit 12. Circuit 12 is responsive to an error signal E that is produced by a comparator 14, whose lower input is connected to a first reference voltage, $V_{R1}$. Circuit 12 may comprise, for instance, the pulse width modulator and a responsive power supply circuit that are respectively shown in FIG. 3 and in FIG. 2 of the above-referenced copending patent application by Joseph M. Allison and others. The upper input of comparator 14 is either a first feedback signal $F_1$ or a second feedback signal $F_2$, depending on the state of a switch 16. A schematically illustrated switch arm 16A of switch 16 is controlled by a schematically illustrated switch linkage 16B from a logic control circuit 18, described below in connection with FIG. 2. Switch 16 is shown schematically in FIG. 1 as a single-pole, double-throw (SPDT) switch. It is, however, preferably embodied as an electronic switch, using, for instance, a combination of the following logic gates (not shown): a Motorola type MC14066B Quad Analog Switch and a Motorola type MC14023 NAND Gate.

First feedback signal $F_1$ is typically produced by a summing amplifier 20 that has an input from a feedback loop 22 supplying non-light information from lamp 10. Typically, feedback loop 22 will feed back voltage and current of the lamp, the mathematical product of which indicates lamp power. Summing amplifier 20 will typically include one or more further inputs, generally designated 24, that may provide a special power profile over time during lamp warm-up; a typical profile starts with an initially high power level, which then decreases during a lamp warm-up interval, such as 40 seconds. Another special power profile may be that provided by the ballast circuit of the above-referenced, copending patent application by Joseph M. Allison and others. Further input(s) 24 may include, for instance, a potentiometer adjustment of the overall power level to lamp 10.

Error signal E is produced by comparator 14 in response to the difference between a feedback signal $F_1$ and the first reference voltage, $V_{R1}$. Feedback signal $F_1$ is produced from non-light information of the lamp, such as lamp voltage and lamp current whose mathematical product represents lamp power. Assuming for the moment that switch arm 16A of switch 16 permanently connected the first feedback signal $F_1$ to the upper input of comparator 14, and that the circuitry for producing second feedback signal $F_2$ were omitted, the remaining ballast circuit could per se be embodied in a conventional circuit, or, for instance, in the lamp ballast circuitry disclosed in the above-referenced U.S. patent application by Joseph M. Allison (the instant inventor) and others.

As mentioned above in the "Background of the Invention," there usually is considerable difficulty in obtaining a uniform level of light produced from high pressure lamp 10 during a warm-up period of the lamp. The use of a non-light feedback signal $F_1$, described above, will usually promote some degree of uniformity in light intensity from lamp 10 during warm-up, but the light variation is still typically too high for consumer preference in some applications. During steady lamp state operation, in contrast, the non-light feedback signal $F_1$ typically provides a considerably more uniform level of light from lamp 10. In accordance with the invention, a separate feedback signal is generated for use during a warm-up period of lamp 10. The second feedback signal, $F_2$, represents a fraction of the light actually produced by the lamp.

Feedback signal $F_2$ is generated in the following manner. A light-intensity sensing device 26, such as a phototransistor, senses a fraction of light 10A from lamp 10. A current signal from sensing device 26 is converted to a voltage signal in operational amplifier 28. Operational amplifier 28 feeds a current into the reference input 30A of a digital-to-analog (D-to-A) converter 30. D-to-A converter 30 produces light feedback signal $F_2'$ based on a digital word received on a plurality of, for instance, eight digital inputs from an up/down counter 32. Feedback signal $F_2'$ is then converted to a voltage constituting light feedback signal $F_2$ in a current-to-voltage converter 34.

Up/down converter 32 adjusts the gain of D-to-A converter 30 based on a digital word stored in up/down counter 32. The digital word is obtained during a calibration mode of up/down counter 32, which occurs while lamp 10 is operating in a steady state manner under control of non-light feedback signal $F_1$. As mentioned above, such non-light feedback signal typically results in a highly uniform level of light produced by lamp 10 during steady state lamp operation. The digital word memorized in up/down counter 32, which sets the gain of D-to-A converter 30, is determined with reference to non-light feedback control during steady state lamp operation, as will become more apparent from the following description.

During operation of lamp 10 in response to the non-light feedback signal $F_1$, a clock signal on input 32A of up/down counter 32, provided from logic control circuit 18, causes the counter to count. The direction of counting, i.e., up or down, is set by the output of a comparator 38 applied to up/down counter input 32B, as further described below. The lower input of comparator 38 is preferably at the first reference voltage, $V_{R1}$, that is also on the lower input of comparator 14, described above. The upper input to comparator 38, meanwhile, comprises the light feedback signal $F_2$, provided as the output of current-to-voltage converter 34. During the time when up/down counter 32 is counting up or down, switch 16 prevents light feedback signal $F_2$ from being received as the upper input of comparator 14; rather, the non-light feedback signal $F_1$ is active during this time as the upper input of comparator 14.

If light feedback signal $F_2$ is below the first reference voltage, $V_{R1}$, comparator 38 applies a signal to counter 32 to cause counting in an "up" direction, which increases the gain of D-to-A converter 30. If light feedback signal $F_2$ thereafter exceeds the first reference voltage, $V_{R1}$, then comparator 38 instructs counter 32 to count down. Such down counting reduces the gain of D-to-A converter 30. In this manner, the count in up/down counter 32 is continuously adjusted during a calibration mode, such that switching of switch 16 from the non-light feedback signal $F_1$ to the light feedback signal $F_2$ would result in substantially no change in light intensity. This desirably avoids a change in light output of the lamp when switching from light feedback control to non-light feedback control.

By calibrating the gain of D-to-A converter 30 with reference to steady state lamp operation under non-light feedback control, the transfer gain from light source 10 to comparator 14 is maintained highly constant, typically to within about 2 percent, against variances that would otherwise result in a 400 percent change in feedback fraction. In this way, the long-term stability of the non-light feedback control used for running the lamp during steady state operation is utilized by the light feedback control circuit for warming up the lamp. A highly uniform intensity of light, typically to within about 5 percent of constant, is thus produced by the lamp during the warm-up period. This approach, moreover, avoids the problems mentioned in the "Background of the Invention" above of (1) producing erratically different levels of light as a result of differences in light intensity measured from the lamp, and (2) of creating an unusually large power usage for the lamp.

Figure 2:
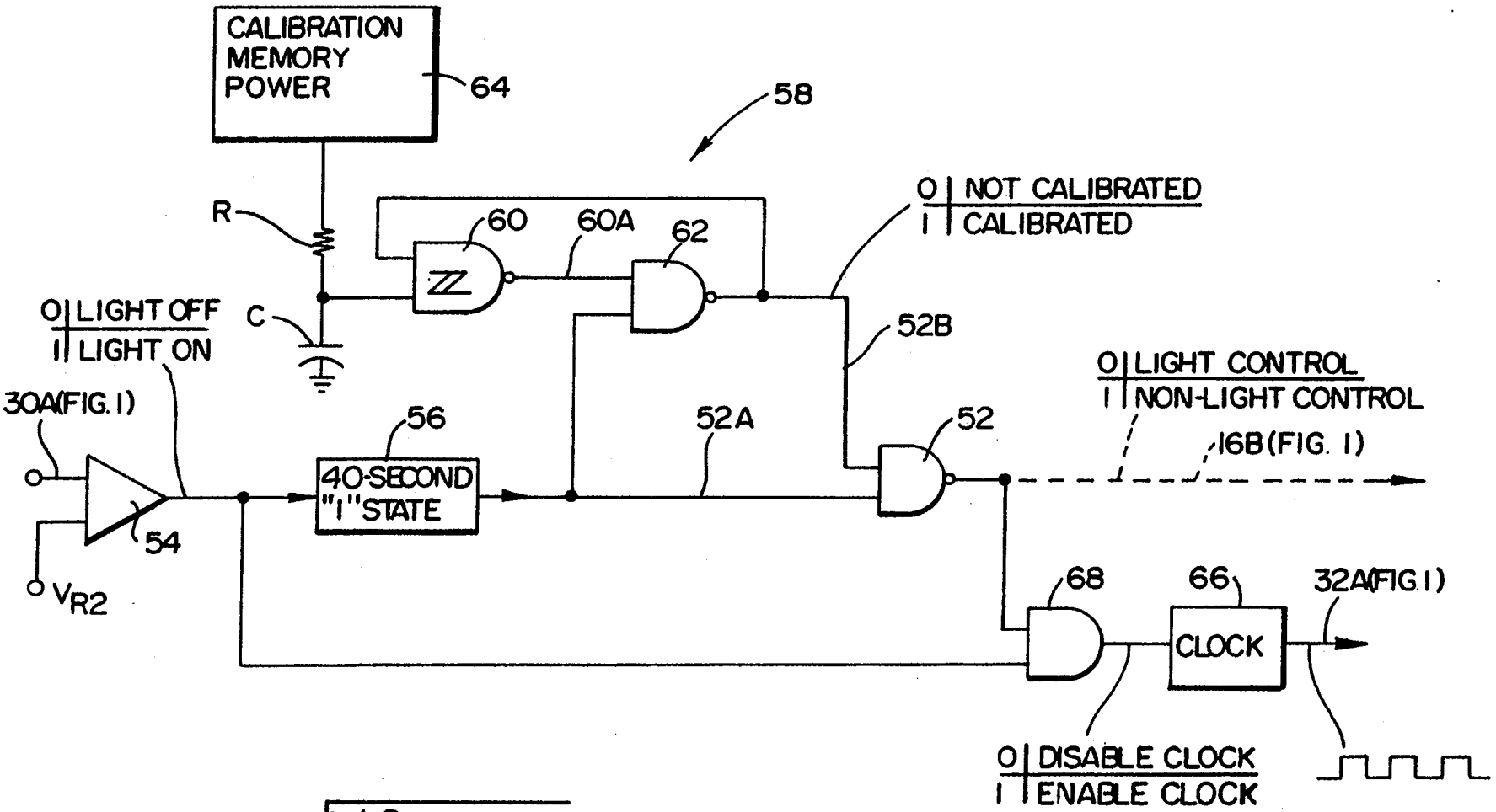
FIG. 2 is a schematic diagram, partially in block form, of a logic circuit for making a lamp power supply circuit within the ballast circuit of FIG. 1 selectively responsive to a non-light feedback signal or to a light feedback signal, and also for providing clock pulses used during a calibration of the light feedback control circuit.

Logic circuit 18 creates the mentioned clock pulses on input 32A to counter 32, as well as controlling switch arm 16A of switch 16 that toggles between non-light, and light, feedback control. FIG. 2 illustrates a preferred circuit for implementing logic control circuit 18.

With reference to FIG. 2, the generation of a control signal on schematic linkage 16B of switch 16 is first described. As indicated by the state diagram shown in connection with linkage 16B, a "0" logic state results in light feedback control, wherein schematic switch arm 16A in FIG. 1 is positioned to receive light feedback signal $F_2$. In contrast, during the logic "1" state of schematic linkage 16B, power control circuit 12 of FIG. 1 is responsive to non-light feedback control, wherein schematic switch arm 16A is positioned to receive non-light feedback signal $F_1$.

The logic output state on schematic linkage 16B is provided by a NAND gate 52 that is responsive to two inputs, 52A and 52B. In accordance with NAND gate operation, NAND gate 52 will provide a logic output state of 0, which results in light feedback control, when each of its inputs 52A and 52B is at a logic 1 state.

NAND gate input 52A is produced as the output of a timer circuit 56 that provides a logic 1 state output during a typical lamp starting period of, e.g., 40 seconds, after detecting a logic 1 (light on) signal from comparator 54. Thus, when an automobile driver, for instance, turns on lamp 10 (FIG. 1), timer circuit 56 will provide a logic 1 state output that starts with the onset of light being detected by comparator 54, and ends after a typical lamp warm-up period of 40 seconds, for instance. Timer circuit 56 can be constructed in conventional manner by employing one section of a Motorola type MC14093 Quad NAND Schmitt Trigger (not shown) in combination with a series-connected resistor and capacitor (not shown) having an RC product of 40 seconds.

The second input, 52B, of NAND gate 52 is provided by a light control-enable latch 58. Light control-enable latch 58 is constructed by providing positive feedback around a pair of NAN D logic gates 60 and 62, which is a conventional technique per se for implementing a bi-stable, or latch, circuit as shown at 58 in FIG. 2. Gate 60 is preferably a Schmitt trigger type (Motorola MC14093B) to accommodate its slow rise-time input taken as the voltage across capacitor C.

When calibration memory power source 64 becomes activated, the voltage on capacitor C rises exponentially to the power source voltage as determined by the RC product of resistor R and capacitor C. This relatively slow rising input to gate 60 is equivalent to providing an initial "0" logic state followed by a steady "1" logic state to the lower input of gate 60. This action forces a predictable power-up state for the latch. This power-up state produces a logical "0" at input 52B of NAND gate 52, which, in turn, forces a non-light feedback control state at the output of gate 52. Light control-enable latch 58 assures that the initial lamp warm-up following the application of memory power is always under non-light feedback control, which is desirable since the light feedback system is initially uncalibrated.

The action of the R-C circuit of the light control-enable latch 58 functions in identical fashion if calibration memory power source has become terminated, for example, by removing a battery power supply for the up/down counter 32. The latch circuit 58 will then continue to produce a logic 0 output until after timer circuit 56 has run its full interval, and operation of power supply circuit 12 under non-light feedback control occurs for sufficient time, even for several seconds, to enable up/down counter 32 to calibrate the gain of D-to-A converter 30 in the manner described above in connection with FIG. 1. If the lamp 10, however, is run for less than the interval programmed into timer circuit 56, the output of latch 58 will remain at a logic 0 state. If the lamp is subsequently run for a greater interval than that programmed into timing circuit 56, latch circuit 58 will then produce a logic 1 output, indicating that a calibrated state of D-to-A converter 30 has been reached.

Logic control circuit 18 also produces the clock pulses received by up/down counter 32 of FIG. 1 on counter input 32A. As mentioned above, the clock pulses enable the calibration of the light feedback signal $F_2$ to occur. In FIG. 2, a clock pulse generator 66 produces a series of pulses on line 32A whenever the output of an AND gate 68, received by the clock pulse generator, is at a logic 1 state. For this to occur, both the upper and lower inputs of AND gate 58 must be at a logic 1 state. The lower input of AND gate 68 is at a logic 1 state when a lamp on condition is detected by comparator 54, which, in turn, applies a logic 1 output to the lower input of AND gate 68. The upper input to AND gate 68 is the logic state output of NAND gate 52 on line 16B. As mentioned above, the logic 1 produced by timer circuit 56 during a lamp warm-up period prevents NAND gate 52 from providing an output of 1 during the lamp warm-up period.

From the foregoing, it will be appreciated that the present invention provides a ballast circuit for a high pressure gas discharge lamp that provides a highly uniform light output during a lamp warm-up period. It is especially useful with high pressure lamps, such as xenon metal halide lamps. It, moreover, avoids the problems mentioned in the "Background of the Invention" above of producing erratically different levels of light as a result of differences in light intensity measured from the lamp, and of creating an unusually large power usage for the lamp. Further, the light feedback circuitry of FIG. 1 and the logic circuitry of FIG. 2 can beneficially be embodied as part of an integrated circuit already used for other control functions, such as implementing power supply circuit 12 (FIG. 1).

Additionally, the present ballast circuit can be easily designed to prevent operation under light feedback control unless the light feedback circuit has been previously calibrated with reference to steady state lamp operation under non-light feedback control. Moreover, if electrical power for the memory of the calibrated gain of the light feedback control circuit falls below a level necessary to reliably store such information, the ballast circuit can be readily designed to prevent warm-up under light feedback control until the gain of the light feedback circuit is again calibrated with reference to steady state operation under non-light feedback control. While the invention has been described with respect to specific embodiments by way of illustration, many modifications and changes will occur to those skilled in the art. It is, therefore, to be understood that the appended claims are intended to cover all such modifications and changes as fall within the true scope and spirit of the invention.

What is claimed is:

1. A ballast circuit for a high pressure gas discharge lamp with light feedback control for promoting uniform light intensity during a warm-up period of the lamp, the light feedback control being automatically calibrated with reference to steady state lamp operation; said ballast circuit comprising:

(a) a comparator circuit for producing a feedback error signal representing the difference between a feedback signal and a reference signal; the feedback signal selectively being one of a non-light feedback signal and a light feedback signal;

(b) a switching circuit effective for making said comparator circuit selectively responsive to one of the non-light feedback signal and the light feedback signal;

(c) a power control circuit effective for adjusting the level of power supplied to the lamp in response to said feedback error signal;

(d) a first, non-light feedback circuit effective for supplying a non-light feedback signal to said comparator circuit, based on non-light information of the lamp that is fed back to said non-light feedback circuit;

(e) a light feedback circuit operative during a lamp warm-up period and being effective for supplying a light feedback signal to said comparator circuit based on light intensity information that is fed back to said light feedback circuit; said light feedback circuit having an adjustable gain as determined by the difference between measured light intensity and magnitude of the light feedback signal produced; and (f) a calibration circuit, operative during steady state lamp operation when said comparator circuit is responsive to the non-light feedback signal, and effective for automatically adjusting the gain of said light feedback circuit until a state is reached in which switching to light feedback control would result in substantially no change in light intensity; said calibration circuit including a calibration memory for storing the gain for use in a subsequent period of lamp warm-up.

2. The ballast circuit of claim 1, wherein said switching circuit includes circuitry effective for making said comparator circuit responsive to the light feedback signal during a lamp warm-up period, rather than the non-light feedback signal, only if said calibration circuit is already calibrated with a desired gain for said light feedback circuit.

3. The ballast circuit of claim 2, wherein said switching circuit includes circuitry effective for making said comparator circuit responsive to the non-light feedback signal during a lamp warm-up period if electric power to said calibration memory has fallen below a level necessary for said memory to continue to reliably store the gain of said light feedback circuit.

4. The ballast circuit of claim 1, wherein the high pressure gas discharge lamp comprises a metal halide gas discharge lamp.

5. The ballast circuit of claim 1, in combination with the high pressure gas discharge lamp.

6. A ballast circuit for a high pressure gas discharge lamp with light feedback control for promoting uniform light intensity during a warm-up period of the lamp, the light feedback control being automatically calibrated with reference to steady state lamp operation; said ballast circuit comprising:

(a) a comparator circuit for producing a feedback error signal representing the difference between a feedback signal and a reference signal; the feedback signal selectively being one of a non-light feedback signal and a light feedback signal;

(b) a switching circuit effective for making said comparator circuit selectively responsive to one of the non-light feedback signal and the light feedback signal;

(c) a power control circuit effective for adjusting the level of power supplied to the lamp in response to said feedback error signal;

(d) a first, non-light feedback circuit effective for supplying a non-light feedback signal to said comparator circuit, based on non-light information of the lamp that is fed back to said non-light feedback circuit;

(e) a light feedback circuit operative during a lamp warm-up period and being effective for supplying a light feedback signal to said comparator circuit based on light intensity information that is fed back to said light feedback circuit; said light feedback circuit including a digital-to-analog converter that is responsive to an analog input signal representing intensity of light from the lamp, that produces an analog output signal representing the light feedback signal, and that has an output-to-input gain determined by a digital word input; and (f) a calibration circuit, operative during steady state lamp operation when said comparator circuit is responsive to the non-light feedback signal, and effective for automatically adjusting the gain of said light feedback circuit; said calibration circuit including a digital up/down counter that produces the digital word received by said digital-to-analog converter for setting converter gain, and that continually counts up or down in response to whether the light feedback signal is above or below a reference value until a state is reached in which switching to light feedback control would result in substantially no change in light intensity; said up/-down counter serving as a calibration memory for storing the digital word for use in a subsequent period of lamp warm-up.

7. The ballast circuit of claim 6, wherein said switching circuit includes circuitry effective for making said comparator circuit responsive to the light feedback signal during a lamp warm-up period, rather than the non-light feedback signal, only if said calibration circuit is already calibrated with a desired gain for said light feedback circuit.

8. The ballast circuit of claim 7, wherein said switching circuit includes circuitry effective for making said comparator circuit responsive to the non-light feedback signal during a lamp warm-up period if electric power to said calibration memory has fallen below a level necessary for said memory to continue to reliably store the gain of said light feedback circuit.

9. The ballast circuit of claim 6, wherein the high pressure gas discharge lamp comprises a metal halide gas discharge lamp.

10. The ballast circuit of claim 6, in combination with the high pressure gas discharge lamp.

* * * * *